United States Patent [19]

Moceri

[11] 3,994,194

[45] Nov. 30, 1976

[54] CUTTING APPARATUS

[76] Inventor: Francesco Moceri, 733 Lantz W., Detroit, Mich. 48203

[22] Filed: Jan. 12, 1976

[21] Appl. No.: 648,386

[52] U.S. Cl. ..... 83/527; 83/450; 83/453; 83/594; 83/666; 30/11; 30/310; 408/189

[51] Int. Cl.[2] ..... B26D 1/36; B26D 7/26

[58] Field of Search ..... 83/450, 527, 529, 530, 83/563, 594, 666, 591, 452, 453, 447; 30/11, 300, 310; 408/103, 189; 144/24

[56] References Cited

UNITED STATES PATENTS

| | | | |
|---|---|---|---|
| 1,201,456 | 10/1916 | Gruner | 30/11 |
| 1,661,136 | 2/1928 | Endrezze | 408/189 |
| 1,799,305 | 4/1931 | Lyness | 83/452 X |
| 2,263,637 | 11/1941 | Maupin | 408/189 |
| 2,546,292 | 3/1951 | Bell | 30/310 X |

*Primary Examiner*—Willie G. Abercrombie
*Attorney, Agent, or Firm*—Cullen, Settle, Sloman & Cantor

[57] ABSTRACT

A cutting apparatus for making circular or circular arc-like cuts in a sheet of material such as paper, cloth, leather, plastic, rubber and the like. A substantially planar base is provided to receivably support said sheet and a hinged apertured clamping plate is lowered over the supported sheet to secure it against movement during the cutting operation which takes place through the aperture. An arcuate arm is secured to the base and an elongated portion of the arm positions an internally-threaded vertically-oriented boss above the aperture. An externally-threaded member is operably received within the boss and includes an adjustment disc for turning said member to raise or lower same within said boss. A blade-positioning shaft is received within a vertically-oriented central bore in the member and includes a shoulder to secure the shaft for vertical movement with the member. The lower distal end of the shaft includes a threaded pin for being slideably received within a radius selecting slot of the blade. The threaded pin may be turned to secure the blade to the lower distal end of the shaft at any selected radial distance from the vertical axis thereof which is defined by a centering tip received into a vertically-oriented bore in the threaded pin. A lever or knob is provided at the upper end of the shaft for rotating same to make the desired cut after the height or depth of the cut has been adjusted by the adjustment disc of the externally threaded member and the proper radius of curvature has been selected.

29 Claims, 8 Drawing Figures

FIG. 1
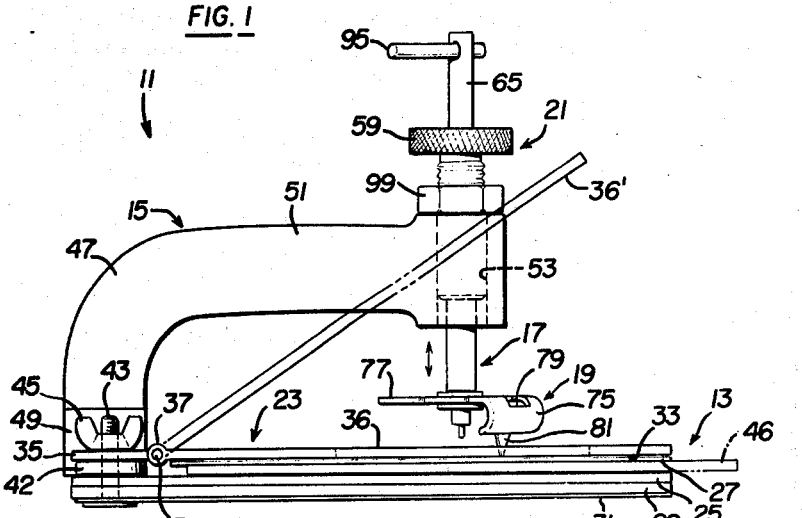
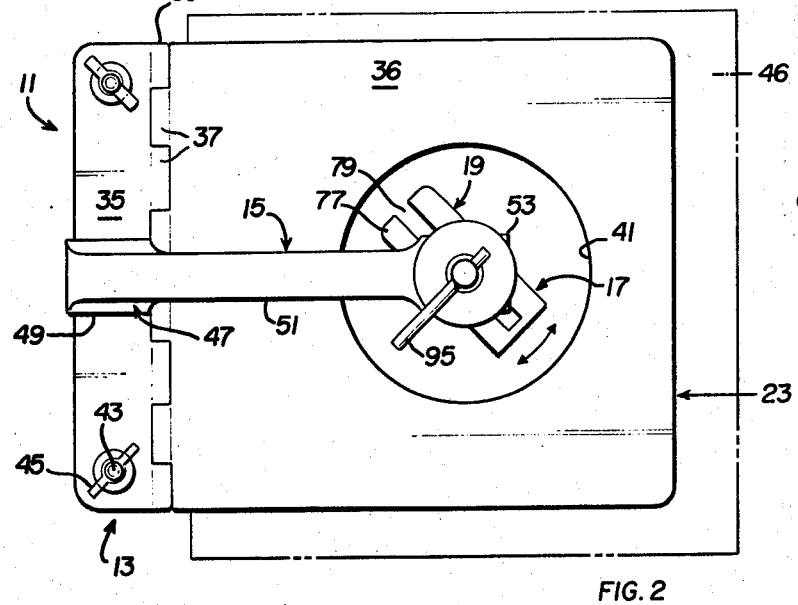
FIG. 2
FIG. 3
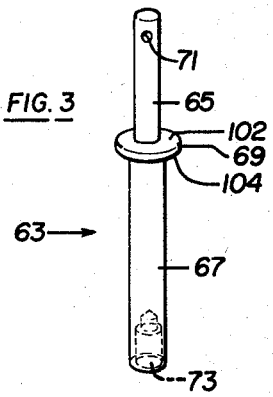
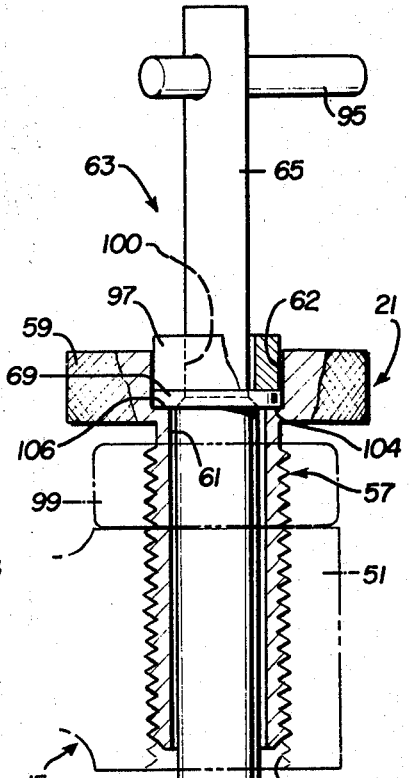
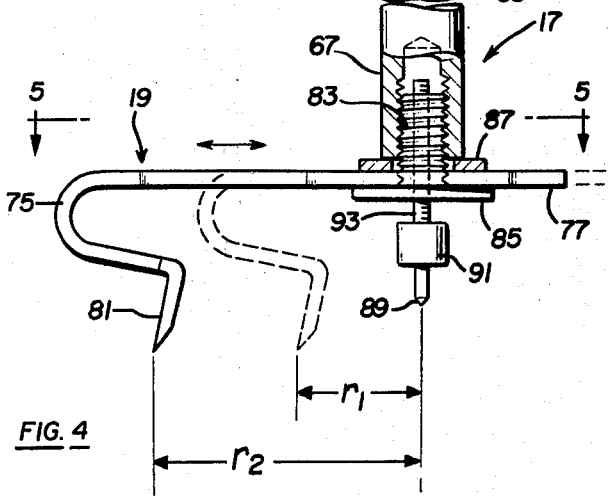
FIG. 4
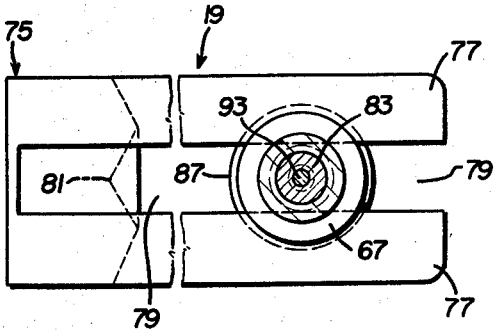
FIG. 5

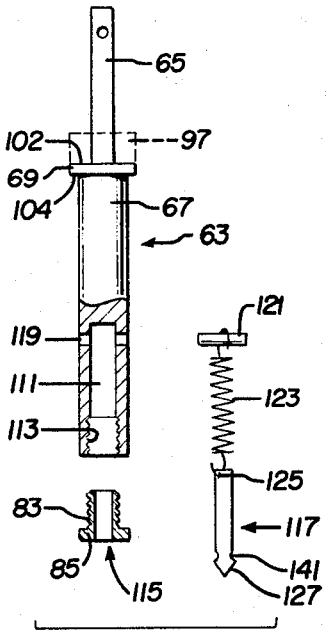
FIG. 6
FIG. 7
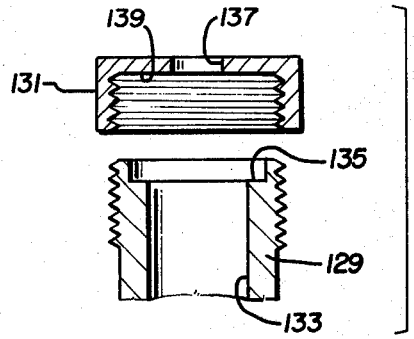
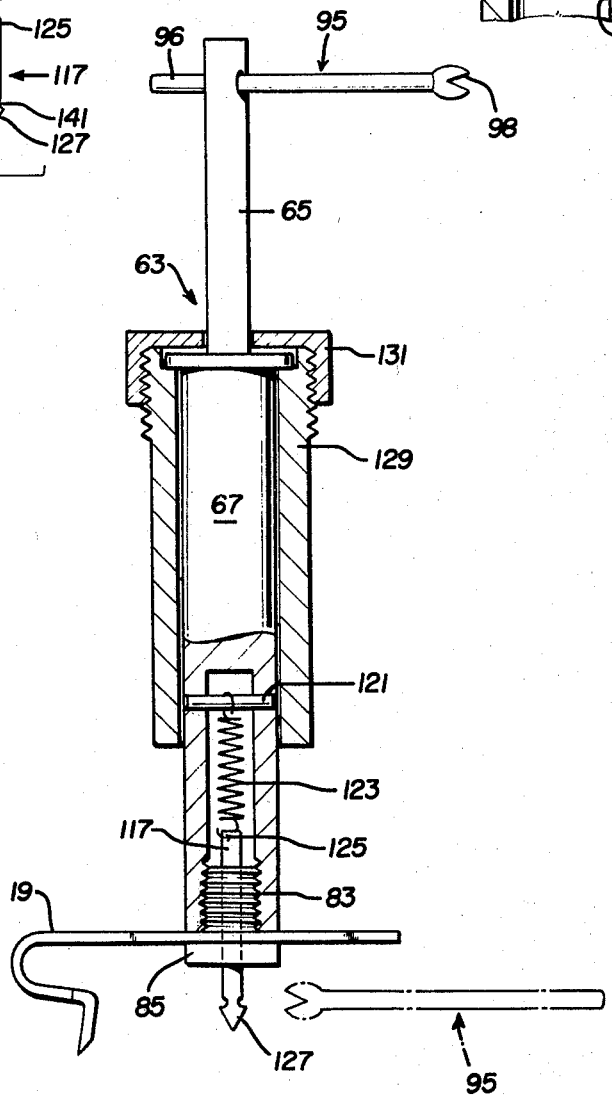
FIG. 8

CUTTING APPARATUS

BACKGROUND OF THE INVENTION

This invention relates generally to cutting apparatus and more particularly to manually-operated cutting apparatus for making circular and circular arc-like cuts in sheets of flexible or semi-rigid material such as paper, cloth, leather, plastic, rubber, and like materials.

The prior art teaches several relatively complex cutting apparatus for making circular or circular are-like cuts but does not teach a simple manually-operable, low cost, easy to maintain apparatus for accurately making circular arc-like cuts at preselected depths and preselected cut radii.

It is often difficult to adjust the radius and the depth of the cut in prior art devices and the speed of making the cut is not always variable. The prior art often requires relatively complex mechanisms for securing the sheet of material while the cut is being made, and some of the systems utilize rather complex alignment mechanisms or indexing schemes to insure that the cut is made at the proper location on the sheet of material. All of these complexities increase of the cost of the cutting apparatus and the resulting product and tend to decrease the efficiency of the production operation.

The present invention solves all of the problems of the prior art with a simple, low cost, easy to maintain, manually-operable cutting apparatus wherein the depth of the cut, its radius, the alignment or indexing of the center of curvature of the cut and the closure and pressure of the clamping means can be accurately and easily adjusted by the operator.

BRIEF DESCRIPTION OF THE DRAWINGS

These and other objects and advantages of the present invention will become more readily apparent by referring to the detailed description of the preferred embodiment, the claims, and the drawings in which:

FIG. 1 discloses a side view showing the cutting apparatus of the present invention;

FIG. 2 shows a top plan view of the cutting apparatus of FIG. 1;

FIg. 3 shows the blade-positioning shaft 63 of FIG. 1 broken away therefrom;

FIG. 4 shows a partial side view, partly in elevation, of the internally threaded boss portion 53 of the arm assembly 15 of FIG. 1 along with the externally threaded vertical adjustment member 21, blade-mounting assembly 17 and cutting blade 19;

FIg. 5 shows a top view of the cutting blade 19 taken along view lines 5—5 of FIG. 4;

FIG. 6 shows a partially exploded side view, partly in section of an alternate embodiment of the shaft of FIG. 3 and centering pin assembly of FIG. 4;

FIG. 7 shows a sectional side view of an alternate embodiment of the vertically positioning assembly of FIG. 4; and FIG. 8 shows a partial side view partly in section, of an alternate embodiment of the apparatus of FIG. 4 employing the apparatus of FIG. 6 and 7.

DESCRIPTION OF THE PREFERRED EMBODIMENT

FIG. 1 shows a side view of the cutting apparatus 11 of the present invention. A base support assembly 13 has secured to one end thereof an arcuate arm assembly 15. The other end of the arcuate arm assembly 15 positions the blade-mounting assembly 17 which adjustably secures the cutting blade 19 proximate the base support assembly 13 at selected but radii. A vertical adjustment member 21 controls the vertical positioning of the cutting blades 19 and hence the depth of the cut.

The base support assembly 13 includes a rigid metal clamping plate 23 and a rigid metal base support plate 25. Disposed intermediate the clamping plate 23 and the base support plate 25 is a tough resilient backing member 27 and a second layer of resilient backing material 29 is affixed to the bottom of the rigid base support plate 25 for cushioning the same. A felt-like layer 31 is affixed to the bottom of the resilient backing layer 29 and a similar felt-like layer 33 is affixed to the bottom portion of the clamping plate 23. The clamping plate 23 includes a secured base portion 35 and an hinged portion 36. The hinged portion 36 is hingeably connected to the secured portion 35 by a hinge assembly 37 formed by integral portions of the secured portion 35 and the hinged portion 36. A hinge pin 39 extends through the hinge assembly 37 so as to hingeably secure the hinged portion 36 to the secured portion 35. The hinged portion 36 has a generally circular aperture 41 in the central portion thereof and the secured portion 35 has a spacing washer 42 disposed beneath the secured portion in contact with the resilient backup member 27. A bolt 43 passes through lower resilient backing lay 29, the base support plate 25, the intermediate resilient backup member 27 and the secured portion 35 of the clamping plate 23. A wing nut 45 or some similar connector is then threaded onto the bolt 43 for securing the base support assembly 13 together.

In operation, the hinged portion 36 of the clamping plate 23 is raised, as shown by the phantom lines labeled 36′ in FIG. 1, and a sheet of material 46 to be cut is inserted between the hinged portion 36 of the clamping plate 23 and the intermediate resilient backup member 27. Once the sheet 46 is receivably supported upon the intermediate resilient backup member 27, the hinged portion 36 is lowered to engage the sheet 46. After the sheet 46 is positioned to align the center of curvature of the proposed cut, as hereinafter described, pressure may be applied to the hinged portion 36 of the clamping plate 23 to secure the sheet 46 against movement during the cutting operation.

The arcuate arm assembly 15 of FIG. 1 includes an arcuate L-shape arm portion 47 having the shorter length or base portion 49 secured to the rigid base support plate 25, as by threaded bolts, rivets or some similar fastening means, not shown but well known in the art. The upper arm of the arcuate portion 47 includes an elongated arm member 51 which extends parallel to the base support assembly 13 and terminates in a vertically-aligned internally-threaded boss or sleeve 53 which is positioned vertically over the center of the aperture 41 of the hinged portion 36 of the clamping plate 23.

As seen in FIG. 4, the vertical adjustment member 21 includes an externally-threaded main body portion 57 terminating in an integral manually-adjustable disc-like member 59. The externally-threaded body portion 57 is operably received within the internally-threaded boss 53 and the disc-like member may be manually turned in either direction to vertically raise or lower the vertical adjustment member 21 within the internally threaded boss 53 to selectively control the depth of the cut. Both the externally-threaded body portion 57 and the disc-like end portion 59 includes a vertically-oriented central bore 61 extending the length thereof for receiving the shaft 63 of the blade-mounting assembly 17.

As illustrated in FIG. 3, the shaft 63 includes an upper portion 65 and a lower portion 67. The upper portion 65 is separated from the lower portion 67 by a shoulder or annular ring member 69. The diameter of the lower portion 67 is substantially greater than the diameter of the upper portion 65 so as to form the shoulder and be separated by the ring 69 at the intersection of the two portions. The upper or distal end of the upper portion 65 has a aperture 71 therethrough and the lower distal end of lower portion 67 has a longitudinally-aligned internally-threaded bore 73 formed therein. The shaft 63 resides within the central vertical bore 61 of the vertical adjustment member 21 and the lower portion 67 extends vertically below the lower end of the internally-threaded boss 53.

The cutting blade assembly 19, as shown in FIGS. 1, 4 and 5, includes a C-shaped portion 75 with the upper end being bifurcated into a pair of elongated member 77 which define an elongated slot 79 having a single open end therebetween. The lower end of the C-shaped portion 75, which is turned back in the longitudinal direction of the elongated slot 79 terminates in a downwardly-oriented triangular cutting point 81. Both the tip of the triangular cutting point 81 and both of its sides are sharpened so as to enable the tip to penetrate the sheets of material 46 to be cut as so as to enable the blade 19 to cut in either a clockwise or counter-clockwise rotational direction.

The cutting blade 19 is mounted to the distal end of the lower portion 67 of the shaft 63 as shown in FIG. 4. As previously described, the lower distal end of the lower portion 67 is provided with an axially-oriented internally-threaded aperture 73. A cylindrically shaped sleeve-like member 83 having both internal and external threads along the central bore thereof terminates in a flanged disc-like manually adjustable end 85. The internally and externally threaded cylindrical sleeve-like member 83 is slideably received within the elongated slot 79 between the bifurcated pair of elongated members 77 so that the cutting blade 19 may be moved radially in or out to define cuts of different radii such $r_1$ and $r_2$ as shown in FIG. 4. The bottom side of the elongated members 77 are supported by the upper surface of the disc-like end 85 and a lock washer 87 is positioned above the upper surface of the elongated members 77 with the internally and externally threaded sleeve-like member 83 passing through the central aperture of the washer. Once the cutting blade 19 has been slideably adjusted as indicated by the double-headed arrow of FIG. 4 to select the desired cutting radius, the disc-like end portion 85 is manually turned in a clockwise direction to thread the sleeve-like portion 83 into the internally threaded distal aperture 73. When the disc-like end 84 has been tightened to thread the sleeve-like portion 83 into the aperture 73, the upper surfaces of the disc-like end 85 will secure the cutting blade 19 rigidly between the disc-like end 85 and the combination of the lock washer and the lip of the distal end of the lower portion 67 of the shaft 63.

Additionally, an alignment or centering pin 89 is provided with an integral nut or gripping portion 91 and an externally-threaded body portion 93. The externally threaded body portion 93 can be adjustably threaded into or out of the internally threaded portion of the sleeve-like element 79 by manually turning the integral nut 91, and the centering pin 89 which is used to define the center of curvature of the arc-like cut which is to be made in the sheet 46 can be raised or lowered over the sheet of material 46 to insure proper alignment. It can, in the alternative, actually be lowered to contact or help hold the sheet 46 during the cutting operation.

A lever arm or handle 95 may be fitted into the top distal aperture 71 of the upper portion 65 of the shaft 63 so that the rate of cutting or the rate of rotation of the shaft 63 can be manually controlled by the operator. A collar 97 can be retainably fitted within the vertical central bore 61 at the top of the disc-like adjusting member 59 and rigidly secured therein by means of a force fit, a snap-fit, a key, a locking pin or some similar means not shown but known in the art. This member 97 has an internal aperture of sufficient diameter to permit the smaller diametered upper portion 65 of the vertical shaft 63 to reside slideably therein but of insufficient diameter to pass the ring 69 and the lower portion 67 of the shaft 63. Hence, the collar 97 rests on the shoulder portion or annular ring 69 to move the shaft 63 vertically up and down as the vertical adjustment member 21 is threaded into or out of the boss 53. In the alternative, the collar 97 could be eliminated and the shaft 63 could be pin-connected or keyed within the vertical central bore 61 itself for motion with the vertical adjustment member 21.

Similarly, a locking nut 99 having an internally-threaded aperture may be threaded onto the externally-threaded body portion 57 of the vertical adjustment member 29 and selectively tightened against the top of the distal end of the arm member 51 which defines the threaded boss 53 to secure the externally threaded body portion 57 against further movement once the vertical depth of the blade 19 has been adjusted by means of the disc-like adjustment member 59.

A lever arm or handle 95 may be fitted into the top distal aperture 71 of the upper portion 65 of the shaft 63 so that the rate of cutting or the rate of the rotation of the shaft 63 can be manually controlled by the operator. The lever arm 95 may include a handle portion 96 at one end thereof and a V-shaped pair of prongs 98 at the other end thereof. The purpose of the prongs 98 will be explained hereinafter.

A collar 97 can be retainably secured within the vertical central bore or counterbore 62 which is a wider-diameter extension of the central bore 61 adjacent the top of the disc-like adjustment member 59 and rigidly secured therein by means of a forced fit, a snap-fit, a key means, a locking pin or some similar means not shown but known in the art. The collar 97 has an internal aperture 100 of sufficient diameter to permit the smaller-diameter upper portion 65 of the vertical shaft 63 to reside slideably therein but of insufficient diameter to pass the annular ring member 69 or the lower portion 67 of the shaft 63. When the collar 97 is securedly fitted within the upper end of the adjusting member 59, it bears against the upper surface 102 of the ring member 69. The radially peripheral portion of the lower surface 104 of the ring member 69 rests against a shoulder 106 formed where the larger diametered aperture 62 tapers inwardly to meet the lesser diametered central aperture 61 of the adjusting member 59. Since the annular shoulder or ring 69 is rigidly secured between the collar 97 at its upper end and the shoulder portion 106 of the adjusting member 53 at its lower end, any threaded adjustment of the member 59 will raise or lower the shaft 63 since it is rigidly secured for vertical movement with the adjusting member 59 via the annular ring or shoulder 69.

In one alternative embodiment, the collar 97 can be eliminated completely and the shaft 63 can be pin-connected or keyed within the vertical central bore 61 itself for motion with the vertical adjusting member 21.

Similarly, a locking nut 99 having an internally threaded aperture may be threaded onto the externally-threaded body portion 57 of the vertical adjustment member 21 and selectively tightened against the top of the distal end of the arm member 51 which defines the threaded boss 53 to secure the externally-threaded body portion 57 against further movement once the vertical depth of the blade 19 has been adjusted by means of the disc-like adjustment member 59.

An alternate embodiment of the shaft 63 and the centering pin assembly of FIG. 4 is shown in FIG. 6. The shaft 63 includes a lesser diametered upper portion 65 and a greater diametered lower portion 67. An annular ring or rim member 69 separates the upper portion 65 from the lower portion 67 and shaft 63 may be rigidly secured within the vertical adjustment assembly 21 by the collar 97, shown in phantom lines in FIG. 6, or, in the alternative, via the means shown in FIGS. 7 and 8. The lower portion 67 has a substantially hollow central bore 111 having an internally threaded portion 113 at its lower distal end. The threaded portion 113 is adapted to threadedly receive and engage the externally threaded sleeve-like portion 83 with this disc-like end 85 as previously described for clampably locking the blade 19 at its desired radial cutting position. Additionally, the sleeve-like portion 83 has a centrally hollow axial bore 115 adapted to receive a centering pin 117 adjacent the top of the central bore 111. The lower portion 67 of the shaft 63 is provided with an aperture 119 through a diameter thereof. The aperture 119 is adapted to receivably engage a pin 121. Once the pin 121 is inserted within the aperture 119, a spring member 123 has its upper end anchored to the pin 121 and its lower end secured through an aperture 125 in the upper end of the centering pin 117. The opposite end of the centering pin terminates in a diamond-shaped or triangularly pointed end portion 127 for engaging the materials 27 to be cut and locating the center of curvature from which the cut will be made. It will, of course, be realized that the pin 121, the spring 123 and the centering pin 117 reside within the bore 111 and 115 and are shown outside thereof for explanatory purposes only.

FIG. 7 shows an alternate embodiment to the adjustment assembly 21 of FIg. 4 which includes an externally-threaded body portion 57 integrally terminating in a manually adjustable disc-like member 59. The embodiment of FIG. 7 shows two separate pieces rather than a single integral piece. The embodiment of FIG. 7 shows an externally-threaded main body portion 129 adapted to be threadedly received within the internally-threaded aperture 57 of the boss 51. A separate manually-adjustable disc-like member 131 having internal threads adapted to receivably engage the external threads of member 129 is also provided. The externally-threaded body portion 129 has a centrally hollow bore 133 adapted to receive the larger-diametered lower portion 67 of the shaft 63 and an annular shoulder portion 135 adjacent the uppeer distal end thereof and internal to the aperture 133 adapted to receive the lower surface 104 of the ring-like member 69 of the shaft 63. The manually-adjustable member 131 includes a central aperture 137 adapted to receive the narrow diametered upper portion 65 of the shaft 63 and a lower surface 139 adapted to engage the upper surface 102 of the annular ring 69 to lockably retain the ring 69 between the threaded sleeve 129 and the adjustable member 131.

FIG. 8 shows an alternate embodiment of the mechanism of FIG. 4 employing the alternate embodiments of FIGS. 6 and 7. The blade 19 is lockably secured to the desired position by turning the disc-like member 85 to thread the member 83 into the internally-threaded portion 113 of the shaft 63. The annular ring of 69 is lockably secured between the adjustable member 131 and the sleeve member 129 since its upper surface 102 is lockably held in place by the under surface 139 of the adjustable member 131 and the radially peripheral under surface 104 of the ring 69 rests securely against the shoulder 135 of the threaded sleeve 129. The pin 121 is inserted with the aperture 119 of the lower portion 67 and the spring 123 is anchored thereto. The opposite end of the spring engages the aperture 125 in one end of the centering pin 117 and the pointed end 127 of the pin 117 protrudes out of the aperture 115 towards the workpiece 27.

In one embodiment of the apparatus of FIG. 8, the spring 123 is a compression spring which tends to bias the centering pin 117 upwardly into the opening or bore 111, and in this embodiment, the V-shaped prong portion 98 of the lever arm 95 arm can be operably engaged with the narrow neck portion 141 of the centering pin 117 just behing the pointed end 127 so that the pointed end 127 can be lowered manually to locate the center of curvature of the desired cut and then released to be automatic retracted under the force of the spring 123 out of engagement with the material to be cut and back into the bore 111. Alternately, this spring could be a tension spring which tends to force the centering pin out of the cavity 111 so that once the center of curvature is located, its contact with the material to be cut will force the pin back into the cavity 111 against the bias of the spring 123 without damaging the material 27.

In operation, with reference to FIGS. 1 and 4, the hinged portion 36 of the clamping plate is raised and a sheet of material 46 to be cut is receivably supported upon the intermediate resilient backup member 27. The hinged portion 36 of the clamping plate 23 is then lowered and the centering pin 89 is threadedly lowered by the integral nut 91 until it is vertically positioned above the desired center of curvature for the proposed arc-like cut. Once the sheet 46 has been properly positioned, force may be applied to the closed clamping plate 23 to secure the sheet 46 between the hinged clamping plate portion 36 and the intermediate resilient backup member 27. As known in the art, additional external clamping means such as a common C-clamp could be used to supply the clamping force. The flanged adjustment end 85 of the internally and externally threaded sleeve-like member 83 is loosened and the cutter blade assembly 19 has the bifurcated elements 77 slideably adjusted along the threaded sleeve-like portion 83 the desired radius of curvature, as measured between the vertical axis of the centering pin 89 and the cutting tip 81 of the blade 19, is selected. Once the proper radius of curvature has been selected, the flange end portion 85 is turned until the blade 19 is securely positioned against the distal end of the lower portion 67 of the shaft 63. The depth of the cut or vertical position of the tip 81 of the blade 19 is adjusted by turning the integral disc-like adjustment member 59 to threadedly raise or lower the vertical adjustment member 21 and the shaft 63 which is secured thereto by collar 97. Once the proper depth of the cut has been selected by this adjustment, the locking nut 99 may be tightened to lock the vertical adjustment member 21 against further movement. The operator then grasps the lever arm or handle 95 and rotates the shaft 63 at a speed selected by the operator to rotate the cutting tip 81 of the cutter blade 19 to make the desired cut in the sheet 46 through the length of the arc required.

The operation of the embodiment shown in FIG. 8 is similar to that just described with the following exeeptions. Once the hinged portion 36 of the clamping plate has been raised and a sheet of material 46 is receivably supported upon the intermediate resilient backup member 27, the hinged portion of the clamping plate 23 is lowered. The lever arm 95 is then removed from the aperture 71 and the V-shaped pronged end 98 is used to manually engage the neck portion 141 to lower the pointed end 127 of the centering pin 117 against the bias of the spring 123 until it is vertically positioned above the desired center of curvature for the proposed arc-like cut to be made in the material 46. Once the sheet of material 46 has been properly positioned under the centering pin 117, the pronged end 98 of the lever arm 95 is released to allow the pointed end 127 the centering pin 117 to be drawn back upon into the bore 111 under the force of the spring 123. The clamping plate 23 is then closed to secure the sheet 46 between the hinged clamping plate portion 36 and the intermediate resilient backup member 27. The radius of the cut is described by positioning the cutter blade assembly 19 as previously described and then locking it in the desired position by the members 83, 85. The vertical position is then adjusted as follows. The manually-operable internally threaded member 131 is threaded onto the sleeve 129 to lock the annular ring member 69 therebetween. Continual turning of the threaded member 131 will threadably raise or lower the sleeve 129— shaft 63 combination within the boss 151 until the desired vertical position has been achieved.

It will be readily apparent that circular cuts and cuts having predetermined radius of curvatures may be made easily and accurately to any given desired depth by the present apparatus. While specific apparatus has been shown for describing an illustrative embodiment of the present invention, it will be readily apparent to those skilled in the art that various modifications may be made without departing from the spirit and scope of the present invention which is limited only by the appended claims.

I claim:

1. A manually-operated cutting apparatus for cutting substantially planar sheets of material comprising:

a base assembly including a base support for receivably supporting said sheet of material and a hinged apertured clamping plate closing over said sheet to secure it against said support during cutting;

an arcuate arm having one end mounted to the hinged end of said base assembly and the other end extending parallel to said base assembly and terminating in a vertically oriented threaded boss positioned above the aperture of said clamping plate;

a cutting blade;

a blade mounting assembly including a shaft received within said vertically-oriented threaded boss and having means for adjustably securing said cutting blade at a plurality of radial positions from the vertical axis of said shaft at the lower end thereof, handle means secured to the opposite end of said shaft for manually rotating same, and a shoulder intermediate said ends; and an externally threaded member operably received within said boss and having a vertically-oriented central shaft-receiving bore therethrough, said member terminating in a manually-operable adjustment knob for threading said member into and out of said sleeve to raise and lower said shaft toward and away from said sheet with said threaded member.

2. The cutting apparatus of claim 1 further characterized in that said blade includes an upper bifurcated end having an elongated apertured slot between said bifurcations, a C-shaped portion extending from said bifurcated end and curving back inwardly thereunder, and a sharp triangular pointed blade tip having sharp sides extending substantially vertically down from said inwardly curved portion.

3. The cutting apparatus of claim 2 further characterized in that said shaft includes an internally-threaded axial bore in the lower distal end thereof and said means for adjustably securing said cutter blade includes an externally-threaded post adapted to be threadedly received within said axial bore, said post being slideably received within said elongated slot between said bifurcations for slideably selecting the radius of curvature of a desired cut, and an outwardly flanged member at the external distal end of said post, said bifurcations being engaged by said flanged member such that when said flanged member is rotated to screw said threaded post into said axial bore, said flanged member will secure said blade to the distal end of said shaft.

4. The cutting apparatus of claim 3 further characterized in that said post has an internally-threaded axial bore and said apparatus further includes a centering pin having vertically adjustably height, said centering pin being positioned precisely over the center point of the axis of rotation of said shaft to aid in defining the desired radius of curvature of said cut, said pin including an externally threaded body portion operably received within said axial bore of said post, a pointed centering tip at the lower distal end and an integral nut for manually adjusting the height of said pin.

5. The cutting apparatus of claim 1 further characterized in that said hinged apertured clamping plate is rigid and includes a circular aperture and said base includes a rigid backing plate, a tough resilient cut-backing member disposed between said clamping plate and said rigid backing plate, a substantially planar cushioned backing member secured to the back of said rigid backing plate and means for securing said clamping plate, said resilient backing member, said rigid backing plate and said cushioned backing member at least at the hinged end of said base assembly.

6. The cutting apparatus of claim 1 further characterized in that said externally-threaded member has a manually-operated locking nut threaded thereon intermediate its threaded end and said ajustment knob for lockably securing said member at a selected vertical position.

7. A cutting apparatus for making circular and circular arc-like cuts in a sheet of material such as paper, cloth, plastic, leather, rubber and the like comprising:

a base support for receivably supporting said sheet of material to be cut;

a clamping plate positionable over said base support for securing said sheet against movement while said cut is being made, said plate including an aperture through which said cut is made;

an elongated arcuate arm mounted on said base support and having its distal end terminating in an internally-threaded vertically-oriented sleeve positioned centrally above said aperture;

an externally-threaded member operably received within said sleeve and including means for raising and lowering said member within said sleeve said member having a vertically-oriented central bore;

a cutting blade;

a blade-positioning shaft received within said central bore of said member;

blade attachment means for securing said cutting blade to the distal end of said shaft at selected radial positions from the vertical axis of rotation of said shaft; and means coupled to the opposite ends of said shaft for rotating same to make said cut.

8. The cutting apparatus of claim 7 further characterized in that said base support includes a substantially planar rigid metal plate, a sheet of tough resilient cutresistant material disposed between said rigid metal plate and said clamping plate and substantially planar sheet of felt-backed material secured to the back of said rigid metal plate.

9. The cutting apparatus of claim 7 further characterized in that said clamping plate is a substantially planar rigid metal plate having a circular aperture in the end which is hinged to swing up away from said base support.

10. The cutting apparatus of claim 7 further characterized in that said cutting blade includes a C-shaped portion, the upper end of said C-shaped portion including a pair of elongated members positioned substantially parallel to said base support for defining an elongated slot with an open distal end therebetween, the lower end of said C-shaped portion terminating in a downwardly-turned triangularly-shaped sharpened cutting tip.

11. The cutting apparatus of claim 10 further characterized in that the lower distal end of said blade-positioning shaft has an internally-threaded axial bore and said blade attachment means includes an externally-threaded post operably received within said axial bore and a flanged disc-like end portion, said pin being slidably received within the slot defined by said pair of elongated members for selectively defining the desired radius of curvature of a given cut, said disc-like end portion being manually turnable to thread said pin within said bore and securely clamp said blade between the distal end of said shaft and said flanged disc-like member.

12. The cutting apparatus of claim 11 further characterized in that said post has an internally-threaded axial bore and said apparatus further includes a vertically adjustable centering pin positioned on the axial center of rotation of said shaft for defining the center of curvature of a given cut, said centering pin including an upper threaded end operably received within the axial bore of said pin, a pointed indexing tip at the lower distal end thereof and an integral nut intermediate said ends for manually turning said pin to raise or lower said indexing tip.

13. The cutting apparatus of claim 7 further characterized in that said shaft includes an aperture through the upper distal end thereof and said rotating means includes a manually-operated lever arm inserted within said distal aperture for rotating said shaft and making said circular arc cut.

14. The cutting assembly of claim 7 further characterized in that said shaft includes a shoulder portion intermediate said ends, said lower end below said shoulder having a greater diameter than said upper end above said shoulder and said securing means includes a collar received within said central bore of said externally threaded member for engaging said shoulder to force said shaft vertically downward with said externally threaded member.

15. The cutting apparatus of claim 7 further characterized in that said apparatus further includes an internally threaded locking nut operably received on said externally threaded member for locking same against movement while said cutting is performed.

16. The cutting apparatus of claim 7 further characterized in that said clamping plate includes a layer of felt-like material coating the hinged underside thereof for contacting said sheet when said clamping plate is closed during cutting, said layer including an aperture corresponding to said perture in said clamping plate.

17. The cutting apparatus of claim 1 further characterized in that said shoulder is an annular ring-like member having upper and lower surfaces, said externally-threaded member is integral with said adjustment knob, said shaft receiving bore terminates in a counterbore having a greater diameter through at least a portion of said knob so as to form an internal annular shoulder where said counter-bore terminates, said annular shoulder supporting the lower surface of said ring-like member to prevent the downward movement of said shaft within said bore, said threaded member further including a collar adapted to be securely retained within said counterbore to bear against the upper surface of said ring-like member to prevent the upward movement of said shaft within said bore and insure that said shaft is vertically raised and lowered as said threaded member is screwed out of and into said threaded boss by manually turning said adjustment knob while permitting said shaft to be rotated within said shaft-receiving bore.

18. The cutting apparatus of claim 1 further characterized in that said shoulder is an annular ring-like member having upper and lower engagement surfaces, said vertically-oriented shaft-receiving bore has an annular shoulder portion adjacent the upper distal end thereof for engaging the lower surface of said ring-like member to prevent the vertically downward passage of the shaft within the shaft-receiving bore; and said adjustment knob includes a central aperture to permit the passage of the upper end of said shaft therethrough, a lower locking surface radially adjacent said aperture for engaging the upper surface of said ring-like member to prevent the vertically upward passage of said shaft within said central aperture, and an internally threaded cylindrical portion extending vertically downward from said lower locking surface adapted to be threaded onto said externally-threaded member to be receivably secured thereto thereby locking said ring-like member between said annular shoulder and said lower locking surface for raising and lowering said shaft by threading said externally-threaded member out of and into said boss by rotating said adjustment knob, said shaft being rotatable within said shaft-receiving bore even when vertically locked between said annular shoulder and said locking surface for rotating said blade.

19. The cutting apparatus of claim 3 further characterized in that said post has a smooth axial bore therethrough and said apparatus further includes an elongated centering pin having a pointed end and a portion adapted to be received within said smooth bore and said axial bore, said pointed end being at the lower distal end thereof and being adapted to locate the center of curvature of the cut to be made, said apparatus also including a biasing means, means securing said biasing means to the opposite end of said centering pin, and means anchoring the other end of said biasing means within said axial bore of said shaft.

20. The cutting apparatus of claim 19 further characterized in that said anchoring means is a pin recieved through the axial bore of the shaft adjacent of the upper end thereof, said securing means is an aperture through said other end of said centering pin and said biasing means is a tension spring having one end anchored to said pin and the opposite end secured to said centering pin aperture for normally biasing said distal pointed end away from said material and said centering pin into said axial bore.

21. The cutting apparatus of claim 20 further characterized in that the upper end of said shaft has an aperture therethrough and said apparatus includes a lever arm adapted to be received within said shaft aperture for manually rotating said shaft within said threaded member, said lever arm including one end adapted to engage said pointed end of said centering pin for properly centering said sheet of material for cutting, when said one end of said lever arm releases said pointed end, the biases of said tension spring returns said centering pin to its normal position within said axial bore.

22. The cutting apparatus of claim 19 further characterized in that said anchoring means is an anchor pin received through the axial bore of the shaft, and said biasing means includes a spring having one end anchored to said anchor pin and its other end attached to said other end of the centering pin, said spring normally biasing said pointed end toward said sheet of material and responsive to contact therewith for withdrawing into the smooth bore without damaging the sheet of material.

23. The cutting apparatus of claim 7 further characterized in that said shaft is cylindrical and has an upper portion of a first diameter, a lower portion of a greater diameter and an annular lip intermediate said portions.

24. The cutting apparatus of claim 23 further characterized in that said raising and lowering means is a manually-operably disc-like member integral with said externally threaded member, said disc-like member has a counterbore terminating said vertically-oriented central bore, said lip engaging the shoulder portion of said counterbore to prevent downward movement of said shaft through said central bore, said apparatus also including a collar adapted to be secured within said counterbore to prevent upward movement of said shaft while allowing it to rotate to turn said cutting blade, said counterbore shoulder and said collar vertically locking said shaft for vertical movement with said externally threaded member.

25. The cutting apparatus of claim 23 further characterized in that said raising and lowering means is a manually-operable disc-like member having a central aperture adapted to pass the upper end of said shaft therethrough, a cylindrical hollow lower portion with internal threads at the lower end thereof and a locking surface radially adjacent said central aperture and at the interior upper end of said lower cylindrical portion, said externally-threaded member having an internal counterbore forming a shoulder portion adjacent the upper distal end thereof, said lower cylindrical portion being adapted to threadably engage the uper end of said externally-threaded member to lock said lip between said shoulder portion and said locking surface such that said shaft may be raised and lowered as said externally-threaded member is screwed out of or into said sleeve without interferring with the rotatability of said shaft within said central bore.

26. The cutting apparatus of claim 12 further characterized in that said post has an elongated axial bore communicating with the axial bore of said shaft and said apparatus further includes a centering pin vertically positionable within said axial bores such that when said centering pin is lowered it serves to define the center of curvature of a given cut, said centering pin including an elongated body portion adapted to be received within said axial bores, an aperture adjacent the end of said received body portion and a pointed indexing tip at the lower distal end thereof, said shaft having an anchoring pin extending through the upper end of the axial bore of said shaft and a spring having one end connected to said pin aperture and the other end anchored to said anchoring pin.

27. The cutting apparatus of claim 26 further characterized in that said spring normally biases said centering pin into said axial bores.

28. The cutting apparatus of claim 26 further characterized in that said spring normally biases said centering pin outward from said axial bores.

29. The cutting apparatus of claim 27 further characterized in that said shaft includes an aperture through the upper end thereof and aa rotating arm adapted to be received within said aperture to rotate said shaft, said arm having an indexing tip-engaging structure at one end thereof for engaging the tip of said centering pin and manually lowering the same for indexing purposes.

* * * * *